United States Patent [19]

Audeh

[11] Patent Number: 4,499,949

[45] **Date of Patent: * Feb. 19, 1985**

[54] COMBINED SURFACE AND IN SITU TAR SAND BITUMEN PRODUCTION

[75] Inventor: Costandi A. Audeh, Princeton, N.J.

[73] Assignee: Mobil Oil Corporation, New York, N.Y.

[ * ] Notice: The portion of the term of this patent subsequent to Aug. 9, 2000 has been disclaimed.

[21] Appl. No.: 502,817

[22] Filed: Jun. 9, 1983

[51] Int. Cl.[3] ..... E21B 43/243

[52] U.S. Cl. ..... 166/260; 299/4

[58] Field of Search ..... 299/3, 4, 7; 208/11 R; 166/256, 257, 260, 261, 266, 267, 274

[56] References Cited

U.S. PATENT DOCUMENTS

| | | | |
|---|---|---|---|
| 3,415,573 | 12/1968 | Fraser | 299/7 |
| 3,799,613 | 3/1974 | Hendry | 299/7 |
| 4,241,790 | 12/1980 | Magnie | 166/261 |
| 4,379,489 | 5/1983 | Rollmann | 166/274 |
| 4,397,359 | 8/1983 | Audeh | 166/260 |
| 4,399,314 | 8/1983 | Child | 208/11 R |

FOREIGN PATENT DOCUMENTS

| | | | |
|---|---|---|---|
| 0714354 | 7/1965 | Canada | 166/274 |
| 1018058 | 9/1977 | Canada | 166/274 |

*Primary Examiner*—Stephen J. Novosad
*Assistant Examiner*—William P. Neuder
*Attorney, Agent, or Firm*—Alexander J. McKillop; Michael G. Gilman; Charles A. Malone

[57] ABSTRACT

In-situ combustion of tar sand formations is improved by introducing into an unminable tar sand formation prior to initiation of in-situ combustion hydrogen sulfide produced from upgrading tar sands from a minable tar sand formation in an area proximate the area of the unminable formation. The stream of hydrogen sulfide may contain a small proportion of hydrocarbons condensible at temperature and pressure conditions of the unminable formation. The improvement is applicable to both forward and reverse in-situ combustion processes.

8 Claims, No Drawings

COMBINED SURFACE AND IN SITU TAR SAND BITUMEN PRODUCTION

BACKGROUND OF THE INVENTION

The present invention is directed to a method for recovering hydrocarbons (bitumen) from tar sand deposits. According to the process, hydrogen sulfide is generated by upgrading bitumen produced from minable tar sands and hydrocarbons are recovered from an unminable subterranean tar sand formation in an area proximate to the area of the hydrogen sulfide recovery by utilizing an improved in-situ combustion operation wherein the hydrogen sulfide is injected into the subterranean formation prior to commencement of combustion.

Increasing worldwide demand for petroleum products, combined with continuously increasing prices for petroleum and products recovered therefrom, has prompted a renewed interest in the sources of hydrocarbons which are less accessible than crude oil of the Middle East and other countries. One of the largest deposits of such sources of hydrocarbons comprises tar sands deposits found in Northern Alberta, Canada, and in the Midwest States of the United States. While the estimated deposits of hydrocarbons contained in tar sands are enormous (e.g., the estimated total of the deposits in Alberta, Canada is 250 billion barrels of synthetic crude equivalent), only a small proportion of such deposits can be recovered by currently available mining technologies (e.g., by strip mining). For example, in 1974 it was estimated that not more than about 10 percent of the then estimated 250 billion barrels of synthetic crude equivalent of deposits in Alberta, Canada was recoverable by the then available mining technologies. (See SYNTHETIC FUELS, March 1974, Pages 3–1 through 3–14). The remaining about 90 percent of the deposits must be recovered by various in-situ techniques such as electrical resistance heating, steam injection and in-situ forward and reverse combustion. In addition to tar sands, heavy, viscous crudes and crudes from partially depleted reservoirs are also recoverable by in-situ production techniques.

While details of operating of all of such in-situ techniques vary, a common objective thereof is to lower the viscosity of the hydrocarbon deposits to the point where they can be pumped to the surface of the formation with equipment normally available at the formation site.

Of the aforementioned in-situ recovery methods, in-situ combustion (both forward and reverse) appears to be the most promising method of economically recovering large amounts of hydrocarbon deposits with currently available technology. The attractiveness of the in-situ combustion methods arises primarily from the fact that it requires relatively little energy necessary for sustaining combustion of the hydrocarbon deposits. In contradistinction, other in-situ techniques, such as electrical resistance heating and steam injection require considerable amounts of energy, e.g., to heat the steam at the surface before it is injected into the petroliferous formation.

Conventional in-situ combustion involves drilling of at least two substantially vertical wells into the formation, the wells being separated by a horizontal distance within the formation. One of the wells is designated an injection well, and the other a production well. The recovery of hydrocarbons is accomplished by raising the temperature around a bore hole to the combustion temperature of the petroliferous deposit with some type of a conventional down hole heater/burner apparatus, and then supporting the combustion by injecting an oxidizing gas, e.g., oxygen or air into the formation. There are two basic processes of in-situ combustion, viz., forward and reverse combustion. Forward combustion is initiated at the oxidant injection well and the combustion front propagates toward the production well. Reverse combustion is initiated at the production well and the combustion front propagates toward the oxidant injection well. Hydrocarbon vapors produced during the combustion process are recovered at the surface of the formation and stored in appropriate containers. The combustion is conducted at a temperature not to exceed 1500° F. for about 12 months until the viscosity of oil deposits is reduced to 700–800 cp, generally considered necessary for pumping the oil to the surface of the formation. Further details of forward and reverse in-situ combustion techniques are set forth in SYNTHETIC FUELS, March 1974, pages 3–4 through 3–14, and in THE TAR SANDS OF CANADA by F. W. Camp, pages 27–34, Cameron Engineers, Inc., Denver, Colo., 2nd Edition (1974), the entire contents of which are incorporated herein by reference. Modified in-situ combustion techniques using a combination of oxygen and other chemical substances are also known in the art. For example, Heilman et al., U.S. Pat. No. 2,718,263 uses a mixture of oxygen-containing gas and fuel to generate heat in the formation, and Elzinga, U.S. Pat. No. 3,087,541, injects fuel into the formation only after the combustion has started. Both of these modified in-situ prior art combustion processes uses fuels injected externally into the formation either simultaneously with oxygen or after the injection of oxygen to control the direction of speed of propagation of the combustion front.

However, heretofore practiced in-situ combustion techniques have resulted in a relatively low rate of recovery of available hydrocarbons from subterranean petroliferous formations. For example, the rates of recovery have been reported to be less than about 50 percent of the total deposits of tar sands, e.g., SYNTHETIC FUELS, March 1974, pages 3–4 through 3–14.

Tar sand formations with an overburden greater than 500 feet are not amenable to recovery by surface mining. Such formations present a problem as to ways and means of economic recovery. The techniques available for such recovery are limited and are restricted to in situ techniques. Many in situ techniques have been considered such as electrical resistance heating, steam injection and fire flooding. Inherent problems exist in all in situ methods, for example, poor volumetric sweep, fluid displacement profiles in steam injection and difficulty in starting combustion and maintaining design temperatures in fire flooding. Other tar sand formations that do not have such a thick overburden are amenable to surface mining techniques. Usually the overburden is removed and the underlying desirable tar sand is scooped up and processed for hydrocarbon recovery. Many procedures have been described for this separation of which the Clark Hot Water process is typical.

As recovered the bitumen is not usuable and is usually upgraded by delayed or fluid coking. This coking step produces a liquid product which is usually fractionated into three products. Each of these products is further upgraded by hydrogen treatment. As a result of this upgrading step, the sulfur usually contained in the products is converted to hydrogen sulfide.

Hydrogen sulfide has very limited or no use as a product and usually is converted to elemental sulfur by way of the Claus process. In certain distant locations it may not be possible to sell the sulfur and a large inventory of unsold sulfur could result. It is thus desirable to minimize the amount of sulfur generated on such sites.

Thus, the location of a tar sand recovery plant and its upgrading facilities could be used to advantage so as to minimize the production of sulfur. By selecting a tar sand deposit amenable to surface recovery adjacent to a deposit which is not and which requires the use of in situ production techniques, this desirable minimization of the production of sulfur could be achieved.

In my copending application, Ser. No. 260,521, filed May 4, 1981, there is disclosed an improved in-situ combustion process for the recovery of viscous oil from tar sand formations wherein a combustible gas such as a relatively light hydrocarbon gas having a condensation point of −173° C. to −43° C. or hydrogen sulfide is injected into the formation prior to the initiation of combustion.

The present invention is an improvement of the process disclosed in my copending application described above wherein the hydrogen sulfide injected into the formation prior to initiation of in-situ combustion is produced on site as a by-product in the upgrading of minable tar sands. Therefore, the present invention allows recovery of difficult to produce tar sand formations and at the same time uses available hydrogen sulfide thus minimizing the amount of sulfur produced as a by-product of hydrogen upgrading of products produced from minable tar sands.

SUMMARY OF THE INVENTION

The invention is a method for the recovery of hydrocarbons (bitumen) from a tar sand deposit having a minable tar sand formation and an unminable tar sand formation in an area proximate to the area of the minable formation, said unminable tar sand formation penetrated by at least one injection well and at least one spaced-apart production well, said injection well and production well being in fluid communication with a substantial portion of the unminable formation, comprising mining the tar sands from the minable formation, conveying the mined tar sands to a processing operation wherein the tar sands are processed to recover bitumen and by-product hydrogen sulfide, injecting a predetermined amount of said hydrogen sulfide into said unminable tar sand formation via said injection well, initiating an in-situ combustion reaction in the unminable formation by injecting an oxygen containing gas into the injection well; and continuing to inject an oxygen containing gas into the injection well to propagate the combustion zone through the formation to stimulate recovery of hydrocarbons from the formation via the production well.

DESCRIPTION OF PREFERRED EMBODIMENTS

The present invention involves a process for recovering hydrocarbons (bitumen) from a tar sand deposit having two types of tar sand formations, a minable tar sand deposit in an area proximate to a tar sand deposit which is not minable and which requires the use of in situ production technique to recover hydrocarbons thereform. The mined tar sands are processed on site by various conventional processes such as a "hot water process" to produce a bitumen product that is upgraded by delayed or fluid coking and further upgrading the liquid product produced from the coking step by hydrogen treatment to produce an upgraded oil product and a hydrogen sulfide by-product. Processes of this character are described in Hydrocarbon Processing Vol. 61, September 1982, pages 108–139, 140–154, and 100–163, the disclosure of which is hereby incorporated by reference. The hydrogen sulfide is recovered and used in conjunction with an in-situ combustion operation to recover hydrocarbons from the adjacent tar sand formation that are not amenable to recovery by surface mining. For the purpose of this invention an unminable formation is a formation with an overburden greater than 500 feet.

In the recovery of hydrocarbons (bitumen) by the in-situ combustion phase of the present invention, the subterranean tar sand formation is penetrated by at least one injection well and at last one spaced-apart production well, both wells being in fluid communication with a substantial portion of the oil-containing formation. The hydrogen sulfide recovered from upgrading minable tar sands described above is injected into the lower half of the formation via the injection well, preferably not more than 1 percent to 40 percent of the length of the formation, and most preferably 3 percent to 25 percent of the height of the formation, measured from the bottom thereof. In this connection, the height of the petroliferous formation is defined as the total thickness of the formation, measured from the beginning point below the surface of the earth where the amount of petroliferous materials in the formation is at least 80 percent, preferably 100 percent, to the point above said beginning point of the formation wherein the relative amount of petroliferous material in the formation is at least 95 percent, preferably 100 percent.

The rate of introduction of the hydrogen sulfide into the formation will vary, depending on the formation wherein the process is practiced. Generally speaking, the rate of introduction of the gas and the time realized for the introduction thereof into the formation will be such that the injection will continue until the formation contains at least 30 cu. ft. of hydrogen sulfide per barrel of oil equivalents present in the formation, preferably 30 to 1000 cu ft. of hydrogen sulfide per barrel of oil equivalents present in the formation. Most preferably, the formation will be relatively substantially saturated with the hydrogen sulfide injected therein. In this connection, a point of relative saturation of the formation with the hydrogen sulfide is defined as the point at which the formation cannot absorb appreciable additional quantities of hydrogen sulfide beyond those which have already been absorbed.

The pressure under which the hydrogen sulfide is introduced into the formation will be determined by the depth of the formation below the surface of the earth and by the existing pressure at that depth. For example, in the case of a tar sand deposit the hydrogen sulfide is introduced under a pressure of 20 atm to 100 atm, preferably 60 atm to 80 atm, and most preferably 65 atm to 70 atm, and at a temperature of −40° C. to 100° C., preferably 0° C. to 60° C., and most preferably 25° C. to 35° C.

In an alternative embodiment, the hydrogen sulfide may contain a small proportion (1 percent to 10 percent by volume) of compounds which condense at the temperature and pressure conditions of the formation. The condensed compounds (e.g., methylamine, ethylamine, t-butylamine and hydrocarbons) have a condensation point of not more than 100° C. at ambient pressure and they are dissolved in the petroliferous deposits facilitating the combustion of the latter during the subsequent in-situ combustion. If the condensable compounds used for such purpose are hydrocarbons, they must have a condensation point of at most 100° C. under ambient pressure conditions of about one atmosphere. Suitable condensable hydrocarbons for such purpose are: all hydrocarbons of $C_4$ to $C_7$, such as alkanes, alkenes and aromatics, e.g., n-butane, isobutane, n-pentane, isopentane, hexane, all of its isomers and heptane and all of its isomers, benzene, and toluene, preferably normal pentane and isopentane, hexane, heptane and all of the isomers thereof.

The amount of condensable compounds present in the hydrogen sulfide injected into the formation is 1 percent to 10 percent, preferably 2 percent to 8 percent, and most preferably 3 percent to 5 percent by volume. The condensable compounds dissolve relatively easily in the formation, thereby aiding in the combustion thereof when in-situ combustion is initiated. When the condensable compounds are hydrocarbons, their viscosity should be 0.01 centipoise (cp) to 0.5 centipoise at 40° C. Preferably, the viscosity should be 0.05 centipoise to 0.3 centipoise, and most preferably 0.10 centipoise to 0.15 centipoise at 40° C. The density of the condensable hydrocarbons should be 0.6 to 0.75 g/cm$^3$, preferably 0.62 to 0.67 g/cm$^3$, most preferably 0.65 g/cm$^3$.

The relatively easily condensable hydrocarbons present in the gaseous stream can either comprise a single homogeneous hydrocarbon substance encompassed by any one of the generic groups enumerated above, or they can be a mixture of any of such substances, so long as the relative proportions of the individual components of such mixtures are such that the condensation point, the viscosity, the density and other properties of the mixture fall within the range of the respective properties of the relatively easily condensable hydrocarbons specified above.

After the injection of the hydrogen sulfide, either with or without condensable compounds, is completed, the in-situ combustion proceeds in the usual manner, i.e., the temperature of the formation is brought to or near the combustion temperature and an oxygen containing gas such as oxygen, air, or oxygen enriched air is injected into the formation via the injection well in a conventional manner as described in S. M. Farouq Ali, *A Current Appraisal of In-Situ Combustion Field Tests,* THE JOURNAL OF PETROLEUM TECHNOLOGY, pp. 477–486, (April, 1972), the entire contents of which are incorporated herein by reference. Injection of the oxygen containing gas is continued to propagate the combustion zone through the formation to stimulate recovery of hydrocarbons from the formation via the production well.

The autoignition temperature of hydrogen sulfide ($H_2S$) is about 260° C. Accordingly, ignition of the subterranean petroliferous formation can be initiated at relatively low formation temperatures.

Once the combustion of the petroliferous material has begun, the hydrogen sulfide previously introduced into the formation and which preferably saturates the formation, aids in the combustion, thereby markedly accelerating the entire combustion process and increasing the yield of recoverable hydrocarbons.

From the foregoing specification one skilled in the art can readily ascertain the essential features of this invention and without departing from the spirit and scope thereof can adopt it to various diverse applications.

What is claimed is:

1. The invention is a method for the recovery of hydrocarbons (bitumen) from a tar sand deposit having a minable tar sand formation and an unminable tar sand formation in an area proximate to the area of the minable formation, said unminable tar sand formation penetrated by at least one injection well and at least one spaced-apart production well, said injection well and production well being in fluid communication with a substantial portion of the unminable formation, comprising:

(a) mining the tar sands from the minable formation;
(b) conveying the mined tar sands to a processing operation wherein the tar sands are processed to recover bitumen and by-product hydrogen sulfide;
(c) injecting a predetermined amount of said hydrogen sulfide into said unminable tar sand formation via said injection well;
(d) initiating an in-situ combustion reaction in the unminable formation by injecting an oxygen containing gas into the injection well; and
(e) continuing to inject an oxygen containing gas into the injection well to propagate the combustion zone through the formation to stimulate recovery of hydrocarbons from the formation via the production well.

2. The process according to claim 1 wherein the hydrogen sulfide is injected into the lower portion of the unminable formation.

3. A process according to claim 1 wherein the hydrogen sulfide contains 1 percent to 10 percent by volume of a condensable hydrocarbon gas having a condensation point of not more than 100° C. at a pressure of one atmosphere.

4. A process according to claim 3 wherein said condensable hydrocarbon gas is normal butane, iso-butane, normal pentane, isopentane, hexane, heptane, isomers thereof, or mixtures thereof.

5. A process according to claim 1 wherein said stream of hydrogen sulfide is introduced into the subterranean formation until said subterranean formation is substantially saturated with said hydrogen sulfide.

6. A process according to claim 5 wherein, following said substantial saturation, said hydrogen sulfide undergoes autoignition at about 250° C. and at the ambient pressure of the formation.

7. A process according to claim 1 wherein said hydrogen sulfide contains 1 percent to 10 percent by volume of a condensable compound having a condensation point of not more than than 100° C. at ambient pressure.

8. A process according to claim 7 wherein said condensable compound is normal butane, iso-butane, normal pentane, isopentane, hexane, heptane, isomers thereof, or mixtures thereof, methylamine, t-butylamine, ethylamine and mixtures thereof.

* * * * *